US006446446B1

(12) United States Patent
Cowans

(10) Patent No.: US 6,446,446 B1
(45) Date of Patent: Sep. 10, 2002

(54) EFFICIENT COOLING SYSTEM AND METHOD

(75) Inventor: William W. Cowans, Fullerton, CA (US)

(73) Assignee: Advanced Thermal Sciences Corp., Anaheim, CA (US)

( * ) Notice: Subject to any disclaimer, the term of this patent is extended or adjusted under 35 U.S.C. 154(b) by 0 days.

(21) Appl. No.: 09/947,465

(22) Filed: Sep. 7, 2001

(51) Int. Cl.[7] ..... F25B 4/00; F25B 5/00

(52) U.S. Cl. ..... 62/117; 62/126; 62/196.1; 62/196.4; 62/513

(58) Field of Search ..... 62/117, 126, 196.1, 62/196.7, 224, 513, 524, 498; 165/206, 104.33

(56) References Cited

U.S. PATENT DOCUMENTS

| | | | | |
|---|---|---|---|---|
| 4,702,086 A | * | 10/1987 | Nunn, Sr. et al. | 62/117 X |
| 4,811,568 A | * | 3/1989 | Horan et al. | 62/200 |
| 5,148,978 A | * | 9/1992 | Stapelbroek | 62/225 X |
| 5,197,297 A | * | 3/1993 | Brendel et al. | 62/197 X |
| 5,435,148 A | * | 7/1995 | Sandofsky et al. | |
| 6,058,729 A | * | 3/2000 | Lifson et al. | |
| 6,102,113 A | * | 8/2000 | Cowans | 165/206 |
| 6,209,334 B1 | * | 4/2001 | Cowans et al. | 62/224 |

* cited by examiner

*Primary Examiner*—Chen-Wen Jiang
(74) *Attorney, Agent, or Firm*—Jones, Tullar & Cooper, PC; Raymond A. Bogucki

(57) ABSTRACT

A system and method for controlling the temperature of thermal loads which might be controlled by refrigeration at any temperature within a wide range from −40° C. to +120° C. employs a refrigeration loop with pressure and temperature sensitive shunt paths to provide stabilized refrigerant flow so that a thermal expansion valve can operate stably only with liquid refrigerant inputs. For efficiency, thermal energy is interchanged between refrigerant returning from thermal energy exchange with a thermal load such as a cluster tool used in semiconductor fabrication and counterflow pressurized liquid refrigerant that is to be expanded for heat exchange. If the input in a suction line to the compressor is too high in temperature, a portion of pressurized refrigerant for the thermal expansion valve that is being subcooled prior to feeding to the valve is diverted into counterflow relationship with the subcooling exchange. This diversion both lowers the temperature of the pressurized refrigerant, thereby eliminating the possibility of partial vaporization, and lowers the input temperature to the compressor, preventing overheating. The proportion of flow is sufficiently small not to interfere with the main function of controllably cooling the thermal load. Concurrently, if the pressure input to the compressor drops too low, hot gas from the compressor output is shunted back to the input through a hot gas valve in a second shunt path.

12 Claims, 2 Drawing Sheets

EFFICIENT COOLING SYSTEM AND METHOD

FIELD OF THE INVENTION

This invention relates to efficient refrigeration systems for closely controlling the cooling regulation of thermal loads which may be required to be held at different temperatures which may be anywhere within a wide range.

BACKGROUND IF THE INVENTION

In a number of modem applications requiring refrigeration of thermal loads, there is a need for close control at different command temperatures, which may have to be set at widely different temperatures at different times to accommodate a complex process. Some of these applications also require that the cooling system operate without maintenance over a long period of time, while also being compact and requiring minimal floor space. One example of such a demanding application is the cooling of cluster tools in semiconductor fabricating installations, where different subsequences at different times might require cooling the thermal load to temperatures as low as −40° C. Downtime caused by support equipment cannot be tolerated, and the fabricating tools are so costly that space is at a premium.

A system which has been proven to meet the somewhat conflicting requirements in a fully satisfactory manner is disclosed in Kenneth W. Cowans patent No. 6,102,113, issued Aug. 15, 2000 and entitled "Temperature Control of Individual Tools in a Cluster Tool System". The Cowans system uses high pressure refrigerant with flow controls and thermal energy transfers that are balanced and regulated by the use of temperature and pressure responsive devices at different parts of the refrigeration loop. Reliability and long life operation are enhanced by the use of pressure and temperature responsive valves, and employment of evaporators and heat exchangers which operate stably without deterioration over long periods of time. Internal features are included within the refrigeration loop to guard against excessive or unbalanced temperature and pressure levels to conserve energy. The pressurized refrigerant which is to be expanded to cool the thermal load is passed before expansion through a subcooler and subcooled in counterflow relation to return flows to the compressor. A shunt path between condenser output and the suction line return to the compressor incorporates a desuperheater expansion valve that operates when the compressor approaches too high a temperature to add pressurized refrigerant to the suction line. A pressure responsive hot gas bypass valve also shunts the compressor output to the suction line input in accordance with compressor pressure operating with maximum flow when little or not cooling is required of the system. When such prior system have been required to maintain thermal loads at higher temperatures they have switched to a controlled heating mode, using resistive heating, for example.

However, even greater demands are placed on these systems because of changes demanded in operating of the thermal load, as in more recently developed cluster tools. Whereas earlier systems required controlled heating in an above ambient range, there is now a demand for cooling high temperature loads, at levels up to 120° C. This often places unacceptable conditions on a temperature and pressure balanced refrigeration loop. If the expanded gas refrigerant that is to be returned through a subcooler to the suction input of a compressor is at too high a temperature, then the thermal expansion valve which controls refrigerant flow into the evaporator may be supplied a pressurized refrigerant which is partially vaporized. Because the internal mechanism of the thermal expansion valve regulates liquid flow by orifice size, partial vaporization of the liquid renders the device erratic. Consequently, the pressurized refrigerant flow into the evaporator/heat exchanger system becomes unstable and the thermal load cannot be maintained at the selected temperature. This problem cannot be resolved by removing the subcooler, or by eliminating the desuperheater and/or hot gas bypass valve without materially degrading efficiency or performance, and neither enlargement of the power and size of the compressor nor using a separate chiller for the returned expanded gases from the evaporator/heat exchanger is a practical or economically justifiable answer to the problem.

SUMMARY OF THE INVENTION

A refrigeration system in accordance with the invention for cooling a thermal load to a selected temperature over a range of −40° to 120° C. without destabilization employs a refrigeration loop including a subcooler supplying pressurized refrigerant to a thermal expansion valve that regulates chilling of the thermal load in an evaporator/heat exchanger arrangement. The subcooler is used to improve operation at the lowest temperatures, i.e. about −20° C. Gaseous refrigerant returning from the evaporator/heat exchanger is passed through the subcooler in counterflow relation to the liquid refrigerant to extract more thermal energy from the liquefied refrigerant to improve system efficiency. A desuperheater expansion valve which responds to high temperature levels at the input to the compressor is coupled to shunt a portion of the output flow from the condenser into the return path for expanded gas through the subcooler. If the thermal load is being cooled in a high temperature range, this diversion of a part of the condenser output to the suction line before the subcooler assures that the counterflow input to the thermal expansion valve remains liquid, while also decreasing the compressor input temperature and increasing the input pressure. This enables the refrigeration system to operate reliably with the thermal load in a high temperature mode, and at a level which would otherwise destabilize the refrigeration loop.

Further in accordance with the invention, stabilization is also improved by shunting a portion of the compressor output to the suction line input in accordance with operating pressure. This shunt path includes a pressure responsive hot gas bypass valve that has a nominal closing threshold of 0 psi, but through its inherent impedance may not shut off except with a differential of about 10 psi. Injection of pressurized refrigerant in the suction line at the subcooler also increases the compressor input pressure and reduces the temperature of the input to the compressor to acceptable levels. In accordance with features of the invention, the desuperheater shunt loop diverts in the range of 0 to 10% of the condenser output to the subcooler depending on the cooling load required of the system and drops the temperature of the cold side of the subcooler to approximately 20° C. The hot gas bypass valve diverts approximately 40 to 60% of the compressor output back to the suction line input when fully open. The valve fully opens when no cooling load is required of the system.

Methods of cooling a thermal load in a compressor/condenser system cool high pressure refrigerant delivered to the thermal load using evaporated refrigerant gases after heat exchange with the thermal load. Also, however, they decrease the temperature of the evaporated refrigerant when the thermal load is being chilled at a high level by shunting a portion of the condenser output into the evaporated gases as they are used in subcooling the high pressure refrigerant, thereby to maintain the high pressure refrigerant in liquid state until expansion. Also, when the compressor input is at too low a pressure, the suction line pressure is increased by shunting a portion of the compressor output back to the suction line input.

BRIEF DESCRIPTION OF THE DRAWINGS

A better understanding of the invention may be reference to the following description, taken in conjunction with the accompanying drawings, in which.

DETAILED DESCRIPTION OF THE INVENTION

Figure 1:
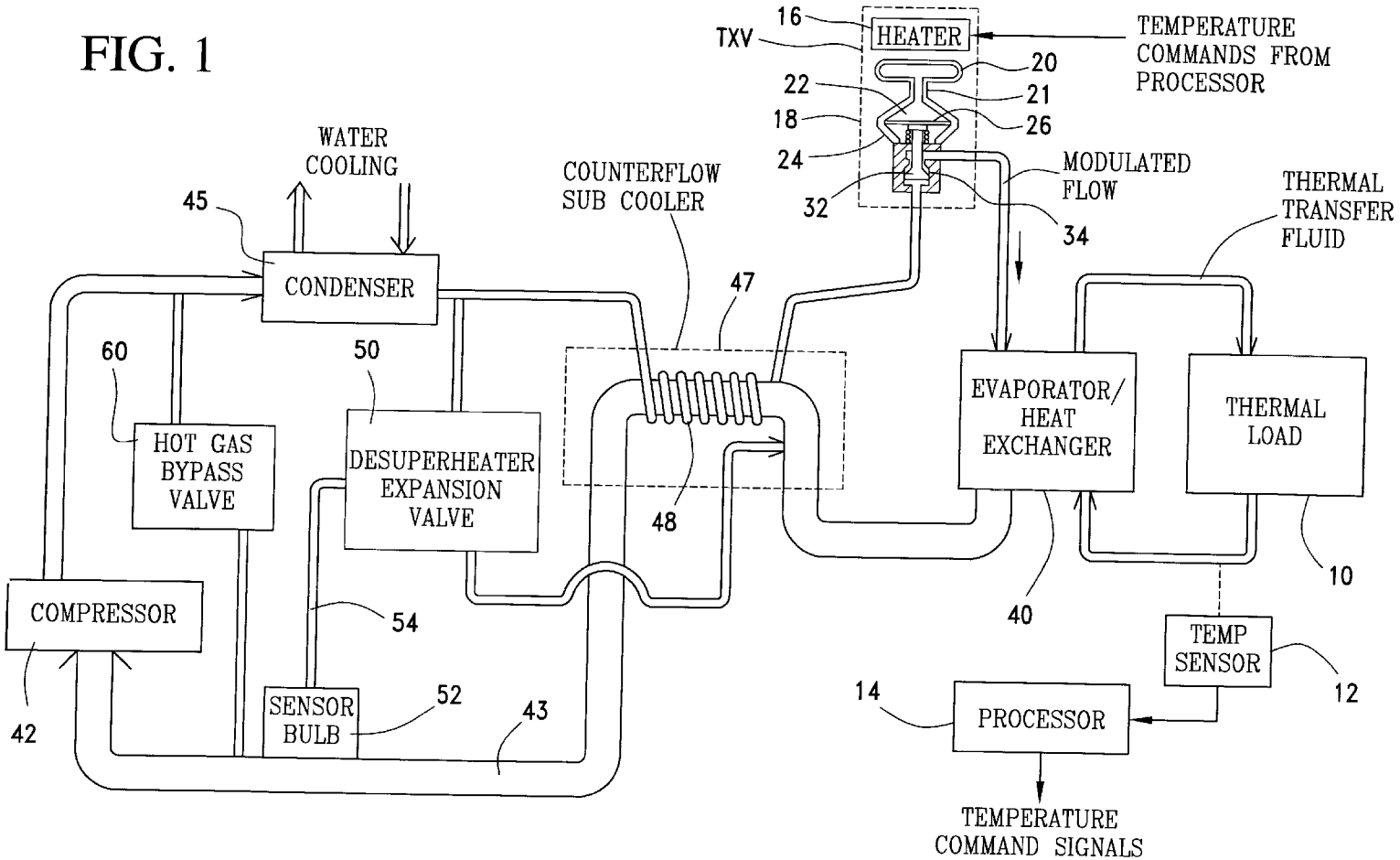
FIG. 1 is a combined block diagram and partial sectional view of a refrigeration system for providing controlled cooling of thermal loads across a wide range of temperatures.

Referring to FIG. 1, the refrigeration loop in a system for controlling the temperature of a thermal load 10, such as a cluster tool in a semiconductor fabrication facility, employs a sensor 12, such as a thermocouple, to establish the existing temperature at the load by sensing the temperature of a component or local region in the tool or the thermal transfer fluid after exiting from the thermal load 10. A processor 14 or control system programmed to operate the tool or other device in various modes receives the temperature measurement signal from the sensor 12 and provides a temperature command or control signal to a control element 16. Here the control element 16 is a heater that functions to regulate a thermal expansion valve 18 in the refrigeration loop, which in turn varies refrigerant flow to the thermal load. As seen in simplified form in FIG. 1 and as described in greater detail in the Petrulio et al. U.S. Pat. No. 5,941,086 on an "Expansion Valve Unit" a thermal expansion valve, or TXV, 18 is temperature responsive and pressure operated. An enclosed bulb 20 confines a gas, typically a refrigerant that communicates via a conduit 21 with the interior chamber 22 of a valve body 24. A flexible diaphragm 26 in the valve body 24 forms a movable wall for the interior chamber 22. The control temperature commanded by the processor 14 energizes the heater 18 and establishes a predetermined pressure in the enclosed volume in the bulb 20, conduit 21 and valve chamber 22. This in turn controls the flexure of the diaphragm 26. An attached, spring loaded movable valve element 32 within the valve body 24 determines the size of an orifice 34 which supplies a modulated flow of pressurized liquid refrigerant from the refrigeration loop to an evaporator/heat exchanger 40. The evaporator/heat exchanger 40, which may comprise separate elements or an integrated unit, first lowers the temperature of the flow modulated refrigerant, which then passes in thermal exchange relation with the thermal load as discussed in the Cowans patent referred to above. These parts of the system are well known and further details need not be discussed here.

In the refrigeration loop, the energy for refrigeration is primarily provided by a compressor 42 receiving input from a suction line 43 and providing pressurized refrigerant output to a water cooled condenser 45, the cooling water input and output being shown only generally. The output from the condenser 45 is pressurized refrigerant at 300–400 psi approximately the coolant temperature. This liquid output is supplied to one input of a counterflow subcooler 47, which also receives an oppositely flowing expanded gas refrigerant on the suction line 43 from the evaporator/heat exchanger 40. this input to the subcooler 47 establishes the relatively cold side of the subcooler. A suitable subcooler 47 geometry disposes the pressurized refrigerant line as a coil 48 wrapped about a straight-through section of the suction line 43. After the subcooling heat exchange, the suction line 43 returns as input to the compressor 42. The subcooler 47 thus functions to lower the temperature of the liquefied refrigerant by using the gases chilled after heat exchange. The expanded output gases from the evaporator/heat exchanger 40 are at a lower temperature than the high pressure liquefied refrigerant that is being fed into the system when the system is required to cool at temperatures below about ambient temperature. If the thermal load is being held at a low to temperature range above about 40° C., the pressure/temperature balance of the liquid refrigerant supplied to the TXV 18 can, however, be destabilized. Even though a differential is maintained in which the refrigerant in the suction line 43 from the evaporator/heat exchanger is 20–30° C. lower than the thermal load, the effect of the subcooler device can heat the liquid to a temperature at which vaporization is achieved if the returned expanded gas is equal to or greater than 40° C. The pressurized liquid refrigerant may then partially vaporize at the input to the TXV 18, which drastically reduces the refrigerant flow that commanded, and thus destabilizes the entire refrigeration loop.

In accordance with the invention, however, a pressure operated but temperature responsive desuperheater expansion valve 50 is used in a shunt path between the output of the condenser 45 and the return or cold input to the counterflow subcooler 47. The desuperheater expansion valve 50 responds, in the manner of the TXV 18, to the pressure in an enclosed volume within a bulb 52 connected by a conduit 54 to the interior of the valve 50. The bulb 52 is disposed in thermal exchange relationship to the suction line 43 before it returns expanded gases to the compressor 42. When the return gases are above a selected threshold temperature, here about 21° C., the desuperheater expansion valve 50 opens to direct a small proportion of the pressurized liquid output from the condenser in the shunt path to the return input to the subcooler 47. This addition cools the counterflowing gases, and accordingly cools both the liquid refrigerant to the TXV 18, and the temperature of the suction line 43 input to the compressor 42. The desuperheater expansion valve 50, when open, shunts from 0% to 10% of the condenser 45 output in the usual instance, the flow being proportioned to the return suction line temperature.

When the thermal load 45 is chilled to control a temperature setpoint of less than about 60° C., the suction line return to the compressor 42, which is at a lower temperature, remains well below the level at which there may be a partial vaporizing effect at the TXV 18. As the temperature at the thermal load 10 rises above 60° C., however, the return temperature of the expanded gas refrigerant to the cold side also increases in temperature of the subcooler 47. By diverting some high pressure refrigerant for expansion and consequent cooling into the returned expanded gases prior to the subcooler 47, however, the liquid refrigerant temperature is lowered, in the subcooler 47, assuring that the input to the TXV 18 remains below the partial vaporization point. The higher the return gas temperature after thermal energy exchange with the thermal load 10, the more the desuperheater expansion valve 50 is opened and the greater the corrective effect, so as to maintain the proper refrigerant supply temperature to the TXV 18.

A second shunt path having a hot gas bypass valve 60 between the pressurized gas output of the compressor 42 and the suction line input 43 is also utilized. The hot gas bypass valve 60 is normally closed at a pressure of about 1 atmosphere absolute (0 psi) and open at 3 atmospheres absolute (30 psi). When open, the valve 60 operates proportionally and feeds back a fraction up to 40% to 60% of the pressurized output from the compressor 42 to the suction line 43 and into the compressor 42 input, to maintain an adequate pressure level when there is no thermal load on the system. Although the hot gas bypass valve 60 is reliable, for long term operations, it is subject to variables in pressure impedance and consequently may not close at the designed pressure level. The shunt path through the desuperheater expansion valve 50, however, provides an added safeguard in this respect, because the flow increment that it adds to the suction line increases the pressure level being returned to the compressor 42, and fully closes the valve 60 when the system is operating at its lowest temperature.

Figure 2:
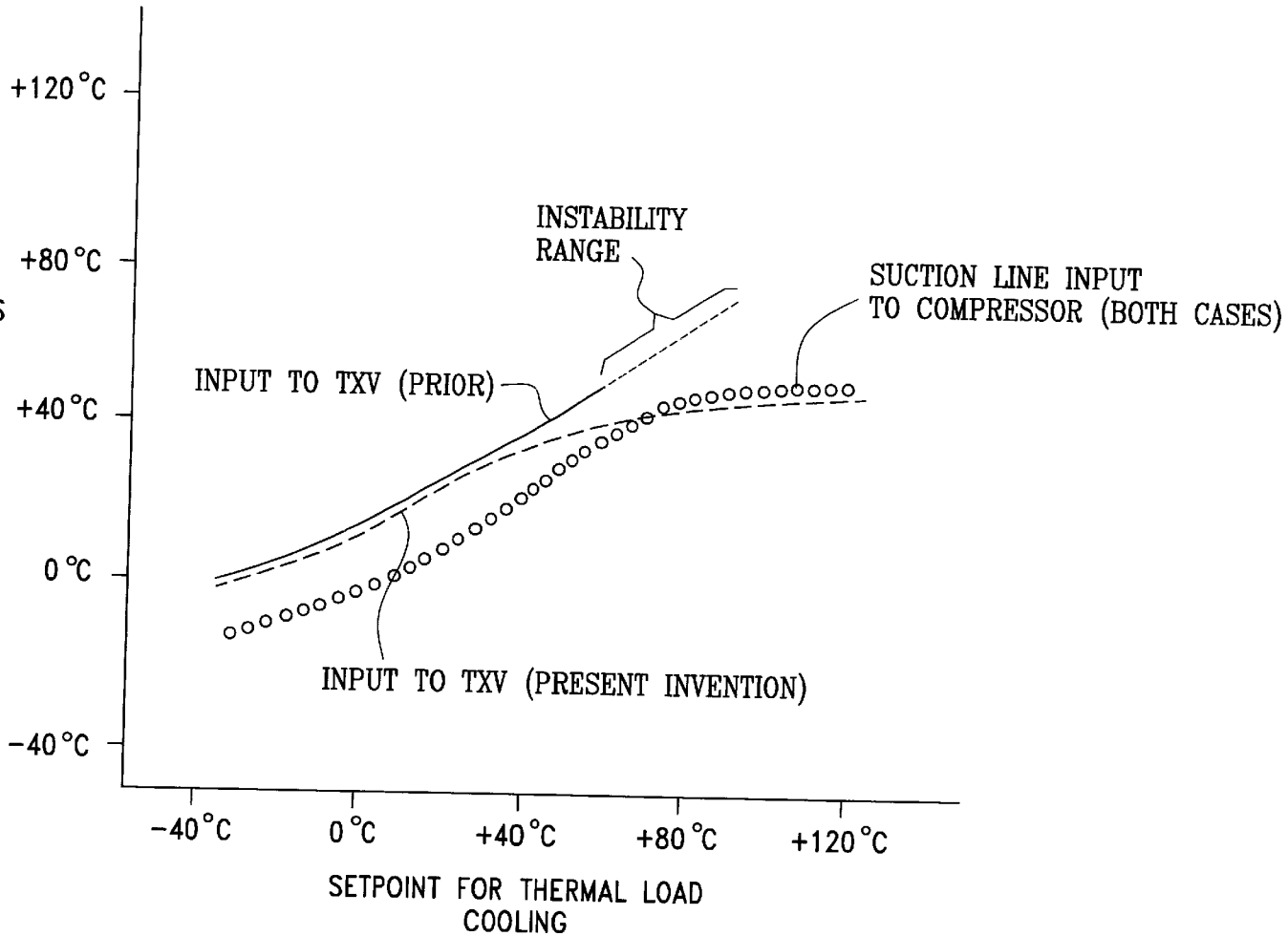
FIG. 2 is a graphical representation of temperature variations experienced at different subunits as a refrigeration loop as shown in FIG. 1 when the system is operated at different thermal load setpoints with and without the features of the invention.

The waveforms of FIG. 2 depict the contrast in the temperature of pressurized refrigerant supplied to the TXV 18 of FIG. 1 between prior systems and systems in accordance with the invention. When the desuperheater expansion valve 50 of FIG. 1 is coupled to the suction line downstream of the subcooler 47, the input to the TVX (curve A) rises with the thermal setpoint level (curve A), as increasingly hotter gases are returned from the evaporator/heat exchanger 40. This increase carries the input to the TXV above 50° C., into the range of instability. In accordance with the invention, however, the shunting of pressurized liquid refrigerant into the cold side of the subcooler 47 via the desuperheater expansion valve 50, decreases the temperature of the input to the TXV 18 (curve B) relative to curve A at the same thermal load level. The maximum temperature reached is less than about +40° C. (40° F.), which assures against partial vaporization of liquid fed to the TXV. In both cases, the pressurized liquid refrigerant fraction shunted into the suction line limits the temperature of the returned flow to the compressor.

Methods in accordance with the invention control the temperature of liquid refrigerant used in an evaporative cooling process so as to preclude partial evaporation before flow modulation. High efficiency chilling of a thermal load is achieved in a closed cycle refrigerant loop that includes counterflow exchange between pressurized liquid refrigerant and expanded gaseous refrigerant after chilling of the thermal load to a selected temperature level. When that level is such that the returned refrigerant would tend to induce partial vaporization in the pressurized refrigerant before flow modulation, a partial flow of pressurized liquid refrigerant is shunted into the returning flow before the counterflow exchange. The shunt flow is proportioned to temperature levels in suction line input before refrigerant compression, and both reduces refrigerant liquid temperature to avoid partial vaporization before flow modulation, and lowers the temperature of flow in the suction input line. It also assures more reliable shunt flow between compressor output and input that is introduced when the suction line input drops toward a negative pressure level that would affect compression when the thermal load is zero or minimal Although there have been described above and illustrated in the drawings various forms and modifications in accordance with the invention it will be recognized that the invention is not limited thereto but encompasses all variations and expedients within the scope of the appended claims.

We claim:

1. The method of cooling a thermal load to a selected temperature with a compressor/condenser system using a pressurized refrigerant when the selected temperature for the thermal load may extend to about 120° C. comprising the steps of:

pressurizing, with the compressor, gaseous refrigerant returned from the thermal load that is being cooled to a maximum gas pressure of 300–400 psi;

cooling the pressurized refrigerant to a liquid state;

subcooling the liquefied refrigerant by exchanging thermal energy between liquefied refrigerant to be used for cooling and expanded gas refrigerant returned for recycling by compression;

modulating the flow of the subcooled liquid refrigerant to provide a controlled proportion of flow for regulating the temperature of the thermal load;

cooling the thermal load by evaporative heat exchange with the controlled proportion of subcooled refrigerant;

returning the expanded refrigerant for compression via the subcooling thermal energy exchange;

diverting a part of the liquefied pressurized refrigerant flow when input temperature of the flow to be compressed is above a selected range; and combining the diverted flow with the returned gas refrigerant used in subcooling to lower the liquid refrigerant temperature before modulation and expansion.

2. A method as set forth in claim 1 above, wherein the returned refrigerant after exchange with the thermal load is at greater than about 40° C. and the step of diverting is undertaken when the compressor temperature approaches overheating.

3. A method as set forth in cl aim 2 above, wherein the step of diverting also cools expanded gaseous refrigerant returning to the compressor to prevent overheating.

4. A method as set forth in claim 3 above, wherein the step of combining lowers the temperature of pressurized liquid refrigerant after subcooling to below partial evaporation level, when the refrigerant flow is to be modulated for cooling a thermal load to a temperature in the 60–120° C. range.

5. A method as set forth in claim 1 above, further including the step of also bypassing the compressor output to input when the compressor input pressure is below a selected threshold.

6. The method of cooling a thermal load with a compressor/condenser system providing a high pressure refrigerant to be evaporated in heat exchange with a thermal load which may have to be cooled at high temperature as well as low, comprising the steps of:

recycling the refrigerant through the compressor/condenser system and the heat exchange evaporator while cooling high pressure refrigerant delivered to the thermal load with evaporated gases at low pressure returning from heat exchange with the thermal load to maintain the high pressure refrigerant in liquid state until expansion;

decreasing the compressor input temperature when the compressor input approaches its high temperature limit by shunting a portion of the output from the condenser to join the evaporated gases used in cooling the high pressure refrigerant; and varying the low pressure return to the compressor by shunting a portion of the output from the compressor back to the input when the compressor input is at too low a pressure.

7. The method of operating a refrigeration system having a compressor supplying pressurized refrigerant through a condenser and a subcooling unit to a thermal expansion valve for regulating cooling of a load at a selected temperature within a wide range of temperature, including higher levels which may destabilize the system because refrigerant returned in a suction line through a subcooler to the compressor may result in some evaporation in liquid refrigerant supplied to the thermal expansion valve, due to the temperature of the pressurized refrigerant, wherein the method comprises the steps of, diverting a portion of refrigerant flow from the condenser into the suction line in liquefied form upstream of the cold side of the subcooler; and shunting a portion of the gaseous refrigerant output from the compressor back to the compressor input when the gaseous refrigerant input is below a selected pressure range.

8. A method as set forth in claim 7 above, wherein the range of temperatures to which the load must be cooled varies upwardly to about +120° C., and the diverted flow lowers the refrigerant temperature in the line to the thermal expansion valve to below about +40° C.

9. A refrigeration system for cooling a thermal load to a selected temperature over a range of −40° C. to 120° C. without destabilization, comprising:

a compressor providing a pressurized gaseous refrigerant on an output line and having a suction line for receiving gaseous refrigerant that is returned after cooling the thermal load;

a condenser coupled to receive gaseous refrigerant from the compressor output line and including, on an output line to provide pressurized liquid refrigerant for cooling the load;

a subcooler with a refrigerant input and output for receiving the condenser output line and having a suction line input and output for transferring thermal energy between the liquid refrigerant and the returned refrigerant in the suction line;

an evaporator/heat exchanger in thermal energy exchange relation to the thermal load and coupled to receive pressurized liquid refrigerant from the subcooler and return expanded gaseous refrigerant to the suction line after thermal energy interchange with the thermal load;

an expansion control valve in the refrigerant line between the subcooler and the evaporator/heat exchanger, for controlling refrigerant flow to maintain the thermal load at the selected temperature;

a desuperheater expansion valve coupling the condenser output to the suction line input at the subcooler; and a hot gas bypass valve coupled to shunt a portion of the compressor output to the suction line to the compressor downstream of the subcooler in response to compressor input pressure below a selected level.

10. A refrigeration system as set forth in claim 9 above, wherein the desuperheater expansion valve comprises a sensor positioned to be responsive to the temperature of the refrigerant at the suction line to the compressor, and the desuperheater expansion valve couples liquid refrigerant flows from the condenser to the suction line input to the subcooler responsively to the sensed temperature, and the hot gas bypass valve shunts a portion of the compressor output in response to a minimal requirement for refrigeration at the thermal load.

11. A refrigeration system as set forth in claim 10 above, the expansion control valve exhibits instability if receiving pressurized liquid refrigerant at a temperature of about 40° C. or more, and wherein the proportion of flow via the desuperheater expansion valve is sufficient to maintain the refrigerant flow to the expansion control valve at below about 40° C. when the suction line flow returning from the evaporator/heat exchanger is substantially higher.

12. A refrigeration system as set forth in claim 11 above, including in addition a temperature control system responsive to a temperature control command for the thermal load and the actual thermal load temperature for operating the expansion valve to control refrigerant flow to the evaporator/heat exchanger and wherein the desuperheater expansion valve supplies, when open, 0–10% of the condenser flow and the hot gas bypass valve supplies up to about 40–60% of the compressor flow in the bypass path.

* * * * *